United States Patent [19]

Solie

[11] 4,003,390

[45] Jan. 18, 1977

[54] HAIR CUTTING GUIDE FOR ELECTRIC RAZOR

[76] Inventor: Edward A. Solie, 5484 Ranchito Way, Santa Rosa, Calif. 95401

[22] Filed: Sept. 8, 1975

[21] Appl. No.: 611,505

[52] U.S. Cl. ..... 132/45 R

[51] Int. Cl.[2] ..... A45D 24/36

[58] Field of Search ..... 132/9, 45; 30/90, 34.2, 30/200, 201

[56] References Cited

UNITED STATES PATENTS

| | | | |
|---|---|---|---|
| 2,629,169 | 2/1953 | Kleinman | 30/34.2 |
| 3,055,376 | 9/1962 | Walls | 132/45 |
| 3,178,815 | 4/1965 | Madrid | 30/90 |
| 3,656,234 | 4/1972 | Regan | 30/90 |

*Primary Examiner*—G.E. McNeill

*Attorney, Agent, or Firm*—Gregg, Hendricson, Caplan & Becker

[57] ABSTRACT

Apertured guide means for electric razors removably engage the head of a razor, and extend therefrom to maintain a predetermined distance between razor blades and surface over which the razor is moved for cutting hair at a predetermined length. The guide means are adapted for use in multiple to provide different predetermined separations of razor blades and surface and guide elements thereof are formed with inclined surfaces for trimming hair.

5 Claims, 7 Drawing Figures

HAIR CUTTING GUIDE FOR ELECTRIC RAZOR

BACKGROUND OF INVENTION

It is known to employ electric hair clippers for cutting or trimming hair on the head or face of a person and commonly professional barbers employ such clippers in conjunction with a comb. The use of hair clippers to contour the hair requires an expertise that is beyond the capability of the average person who is untrained in the art of barbering. Even the use of electric hair clippers to cut hair a uniform length, as in the trimming of a moustache, or beard, or in the performance of a "butch haircut," is quite difficult for an untrained person.

The use of electric razors has become widespread, and at least certain electric razors are provided with hair trimming means. At least certain of these means comprise additional, movable blades adapted to straighten the edges of sideburns or the like. However, these means fall far short of providing the operator of an electic razor with the capability of performing a haircut.

There have been developed and marketed a wide variety of home hair-cutting kits or the like, oftentimes including toothed means mounting razor blades, and while these are applicable to the trimming of hair, they are generally limited in their overall applicability. The increasing cost of haircuts has given quite an impetus to the sale of such kits or the like, and has emphasized the need for additional equipment or devices in this field.

The present invention provides attachment means for conventional electric razors to extend the capabilities thereof to the cutting of hair.

SUMMARY OF INVENTION

An inexpensive guide formed of plastic or the like is adapted to removably engage the head of an electric razor about the blades thereof, and extends above the blades a predetermined distance. The guide is apertured above the blades of the razor so that hair will extend therethrough for cutting by the razor blades.

The guide means of the present invention serves the purpose of holding or displacing the head of a razor a predetermined distance from the head of a person, for example. As the razor with guide means attached thereto is moved over a surface, hair will enter the opening of the guide and be cut at a predetermined length by the razor.

The guide means of this invention may include two or more individual guide elements which clip together to provide a greater predetermined distance between the outer guide surface and the blades of a razor upon which the means are attached. This affords the user with the capability of cutting hair at different desired lengths. Additionally, guide elements in accordance herewith are provided with inclined outer surfaces, so that tapered cuts may be made for trimming hair. The guide means of this invention are normally provided as a set of individual guide members, which may be clipped together or used individually to afford a substantial choice of different cuts by the user.

DESCRIPTION OF FIGURES

The present invention is illustrated as to particular preferred embodiments thereof in the accompanying drawings, wherein.

DESCRIPTION OF PREFERRED EMBODIMENTS

Figure 1:
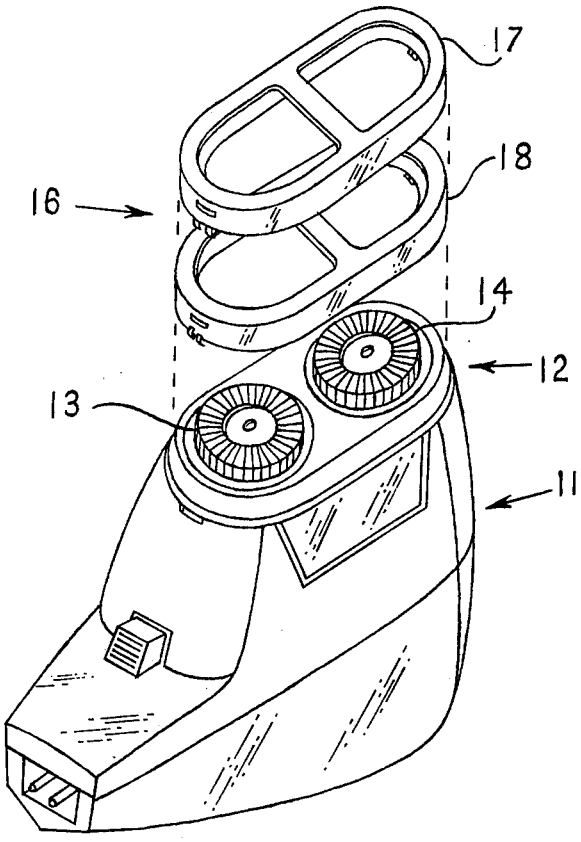
FIG. 1 is a perspective view of one form of electric razor with a pair of guide elements in accordance with the present invention, aligned with and above the head of the razor.

Referring first to FIG. 1 of the drawings, there will be seen to be illustrated an electric razor 11 having a head 12 including a pair of rotary blade mechanisms 13 and 14. It will be appreciated that the present invention is applicable to razors of various configurations, and the one of FIG. 1 is only exemplary. In FIG. 1 there are illustrated guide means 16 in accordance with this invention and including first and second guide elements 17 and 18. These guide elements 17 and 18 may be identical, and the element 17, for example, comprises an upright frame 21 with a top rim or surface 21′ extending inwardly thereabout and having an opening 22 in the top thereof. There may, for example, be provided a cross piece 23 in the open top of the element 17 in order to impart additional rigidity to the structure of the element. The element 18 is also formed with an upright frame 26, and a large opening 27 atop thereof.

The element 17 is provided with one or more clips 28 depending from or forming a part of the lower edge of the frame 21 for removably engaging the element with the head of the razor or with another guide element. To the end of removably connecting guide elements together, the element 17 is provided with one or more depressions or apertures 29 in the frame portion 21. The guide element 18 is similarly formed with depending clips 31 and openings or depressions 32 in the frame 26 thereof. It will be seen from FIG. 2 that the guide element 17 may be readily attached to the element 18 by resiliently deforming the clips 28 to snap to clip into the openings or depressions 32 of the element 18. This will then place the element 17 in connection with the element 18 above same and in parallel relation thereto. The element 18 may be similarly attached to the head 12 of a razor 11 by slipping the resiliently deformable clips 31 over the head, so that the element is firmly attached above the head.

Figure 3:
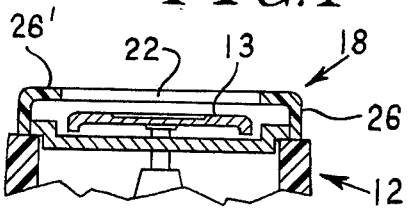
FIG. 3 is a transverse sectional view through a portion of the head of a rotary electric razor with a guide element in accordance herewith mounted thereon.
Figure 2:
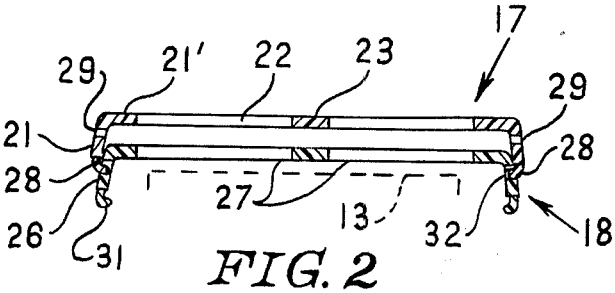
FIG. 2 is a central vertical sectional view of a pair of guide elements in accordance with the present invention, clipped together.

Referring to FIG. 3, there is shown one guide element 18 of the guide means mounted upon the head 12 of a razor. It will be seen that the side frame 26 of the element extends upwardly from the razor head to expose the upper surface or rim 26′ of the frame at a fixed, predetermined distance above the razor blade mechanism 13. With the guide element so mounted, the razor is adapted to perform hair cutting, wherein the length of hair remaining after the cut is substantially the distance from the rim 26′ of the guide 18 to the upper surface of the razor blade mechanism 13. Should it be desired to perform a cutting operation wherein a greater length of hair remains, it is only necessary to clip another guide element 17 upon the guide element 18 to thus space the frame rim 21′ of the guide 17 at a greater predetermined distance from the upper surface of the blade mechanism 13, as illustrated in FIG. 2. By stacking the guide elements, it is possible then to afford the user with the capability of predetermining the length of hair to remain after moving the razor over a beard, moustache or head of a person. It is not intended to indicate that the present invention is applicable only to the cutting of human hair; however, this is merely taken as an example herein.

Figure 1A:
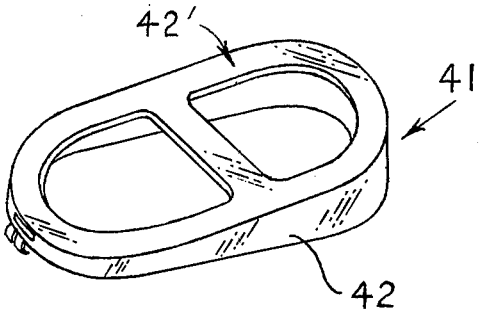
FIG. 1A is a perspective view of a tapered or inclined guide element in accordance with the present invention.

It will be appreciated from the foregoing description that the guide means of the present invention are applicable to convert a conventional electric razor into means for performing butch haircuts, for example. Additionally, the present invention is applicable to the tapering of hair or trimming of same, and to that end reference is made to FIGS. 1A and 1B. In FIG. 1A there is illustrated a guide element 41 having an upright frame portion 42 thereabout, with an upper rim 42′ defining an outer surface of the guide. One or more openings 43 extend through the upper surface of the guide, and one or more cross pieces 44 may be employed to strengthen the structure of the guide. In this embodiment of the invention, the frame 42 is formed with a decreasing height from right to left in FIG. 1A, as illustrated. This then provides for the outer surface of the guide to be inclined with respect to the bottom of the guide. Inasmuch as the bottom of the guide fits flat upon the head of a razor, there is thus provided by guide 41 an outer surface which is inclined with respect to the blade mechanisms of the razor. This inclination extends longitudinally of the guide element 41.

Figure 1B:
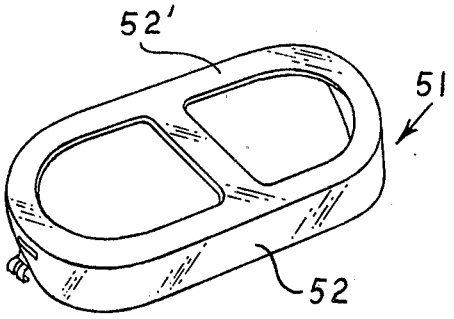
FIG. 1B is a perspective view of an alternatively tapered or inclined guide element in accordance with the present invention.

In FIG. 1B there is illustrated a guide element 51 wherein the frame 52 thereof has a decreasing height laterally thereacross, so that the rim 52′ defining the outer surface of the guide is inclined with respect to blade mechanisms of a razor upon which the guide is mounted laterally across the blades. Both of the guides 41 and 51 are formed of the same bottom dimensions as the guides 17 and 18, and also include clip means in the same positions, so that either of the guides 41 or 51 may be clipped to a guide 17, for example, or directly to the razor head.

Figure 5:
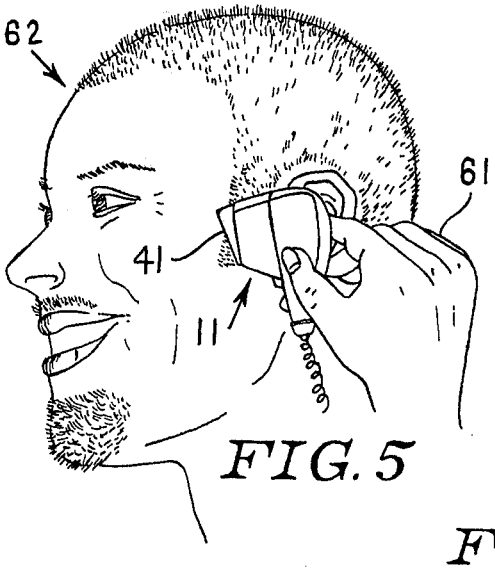
FIG. 5 is an illustration of the use of an electric razor with guide means in accordance with this invention for cutting or trimming hair.

Use of the tapered or inclined guides 41 or 51 is illustrated in FIG. 5, wherein there is shown a razor 11 gripped in the hand 61 of an operator and having a guide 41 mounted on the head of the razor. As also shown in FIG. 5, the guide is placed against the upper side of the face 62 of one whose hair is being trimmed and the razor moved back and forth to thus cut the hair at the sideburns of the person to taper these sideburns from the length of hair on the remainder of the head down to a very small dimension at the bottom of the sideburns. The trimming or taper cutting operation illustrated to be performed in FIG. 5 is substantially automatic, inasmuch as an operator need not attempt to tilt or otherwise maneuver the razor other than to move it back and forth across the area to be cut with a decreasing length of hair from one end of the razor to the other. It will be appreciated that for electric razors having three rotary heads, for example, it is only necessary to provide one inclined guide, rather than the two illustrated in FIGS. 1A and 1B.

Figure 4:
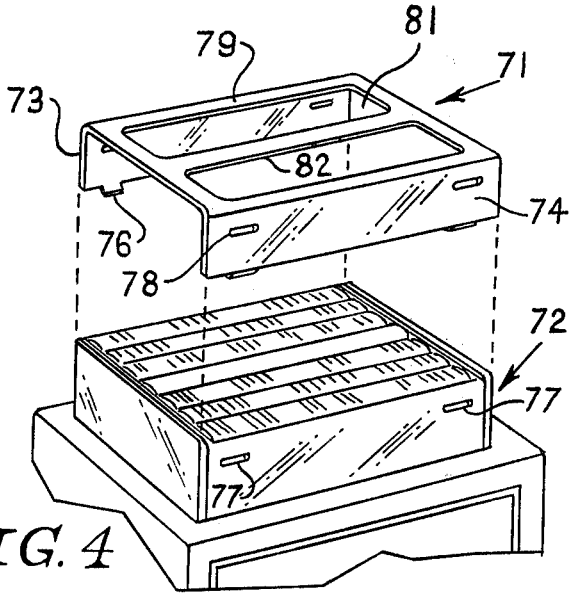
FIG. 4 is a perspective view of an alternative configuration of a guide element in accordance with this invention, displaced above the head of a reciprocating electric razor.

It is to be noted that the guide means of the present invention is adapted for use with substantially any configuration of electric razor. Reference is made to FIG. 4 of the drawings illustrating a guide element 71 which is rectangular in shape to accommodate mounting upon the head 72 of a razor having a rectangular head structure whein the blade mechanisms reciprocate. The guide element 71 is illustrated in FIG. 4 to include a pair of side walls 73 and 74 with clips 76 depending therefrom to clip or snap into depressions or grooves 77 normally present along the sides of the razor head. The location and dimensions of the clips are arranged to engage irregularities in the particular razor for which the guide means are designed. The guide 71 also includes depressions or apertures 78 in the side walls 73 and 74 thereof to accommodate attachment of another like guide element above the guide 71. The side walls 73 and 74 depend from a top surface 79 of the guide which is dimensioned to fit over the blade mechanism of the razor head and having one or more openings 81 therethrough so that hair will extend through the openings for cutting by the razor. A longitudinal brace 82 may be provided on the upper surface 79 to strengthen the guide element, and this brace 82 is normally disposed above a portion of the razor head that did not incorporate razor blades. The foregoing is also true in the structure of guide elements designed for rotary blades, as illustrated in FIG. 1, for example.

It is noted that the guide means of the present invention contain no movable parts, and the members thereof are, in fact, adapted for very simple manufacture out of an inexpensive material, such as a lightweight plastic. Consequently, the guide means of the present invention are very inexpensive items. In practice, the guide means are preferably provided as a plurality of guide members, such as the group of members 17, 18, 41 and 51. Such a group provides the user with the capability of cutting hair to two different depths or lengths, and trimming the hair with two different members.

It will be appreciated that variations of the present invention may be made. Thus, for example, the manner of clipping together separate guide members of the present invention and also of removably mounting one or more guide members upon the head of an electric razor is susceptible to numerous modifications. With the individual members being made or formed of a material which can be flexibly deformed to a small extent, it is possible merely to provide small protuberances upon the inner walls of the frame which are adapted to fit into small indentations on the outside of the frame of another member. The particular location of the clips or attachment means is also widely variable to accommodate the structure of different electric razors. Preferably, the attachment means of two guide members, such as 17 and 18 hereof, are aligned so that the members are interchangeable; however, it will be appreciated that this is not necessary.

Inasmuch as the present invention is susceptible to modification and alteration in part as noted above, it is not intended to limit the present invention to the precise terms of description or details of illustration, for it will be apparent to those skilled in the art that modifications may be made within the spirit and scope of the invention.

What is claimed is:

1. Guide means for an electric razor comprising at least one guide member having means defining an apertured upper surface with a depending frame thereabout dimensioned to fit upon the head of an electric razor and having clip means on said frame for removably engaging said element with the head of an electric razor about blades thereof to dispose said apertured upper surface in predetermined spaced relation above said blades, and said frame having indentations located in line with said clip means adapting said guide member for engagement with another guide member atop same.

2. The guide means of claim 1 further defined by said frame having tapered side walls to thereby dispose the apertured upper surface of the guide member at an angle to the bottom edge of the frame and thus at an angle to blades of a razor head upon which the guide member is mounted.

3. The guide means of claim 1 further defined by a second guide member having an apertured upper surface and with a depending frame thereabout and having clip means on said frame aligned with indentations on said first guide member for attachment of the second guide member onto said first guide member to dispose the apertured upper surface of said second guide means at a second predetermined distance above the blades of a razor to which said first guide member is attached.

4. The guide means of claim 1 further defined by the means defining an upper surface having at least one aperture therein at least coextensive with the blades of an electric razor upon which the member is adapted to mount.

5. The guide means of claim 1 adapted for use with a rotary electric razor having multiple cutting heads and having the upper surface thereof apertured to expose at least all of the surface of all of said cutting heads.

* * * * *